US005407446A

United States Patent [19]

Sando et al.

[11] Patent Number: 5,407,446

[45] Date of Patent: Apr. 18, 1995

[54] METHOD AND APPARATUS FOR THE PRETREATMENT OF A CLOTH

[75] Inventors: Yoshiteru Sando; Eiichi Nakano; Hiroshi Ishidoshiro; Koji Sando, all of Wakayama, Japan

[73] Assignee: Sando Iron Works Co., Ltd., Wakayama, Japan

[21] Appl. No.: 132,474

[22] Filed: Oct. 6, 1993

[30] Foreign Application Priority Data

Nov. 20, 1992 [JP] Japan ..... 4-312349

[51] Int. Cl.[6] ..... D06L 3/04; D06L 1/00; D06M 10/00

[52] U.S. Cl. ..... 8/103; 8/107; 8/111; 8/137.5; 8/138; 8/139; 8/149.2

[58] Field of Search ..... 8/103, 107, 102, 111, 8/137.5, 138, 139, 149.2, 148, 147

[56] References Cited

U.S. PATENT DOCUMENTS 3,265,462 10/1962 Rogers ..... 8/108.1
3,281,202 10/1966 Helmick et al. ..... 8/108.1
4,457,145 7/1984 Sando et al. ..... 8/444

FOREIGN PATENT DOCUMENTS 337305 10/1930 United Kingdom .

*Primary Examiner*—Prince Willis, Jr.
*Assistant Examiner*—Alan D. Diamond
*Attorney, Agent, or Firm*—McAulay Fisher Nissen Goldberg & Kiel

[57] ABSTRACT

A method and an apparatus for the continuous pretreatment of a long cloth produced commercially in completely gaseous system, in which, by utilizing the combination of a desizing and scouring process in a low temperature plasma atmosphere and a bleaching process in an atmosphere of ozone and ultraviolet ray radiation, and thus entirely no application of liquid system.

1 Claim, 1 Drawing Sheet

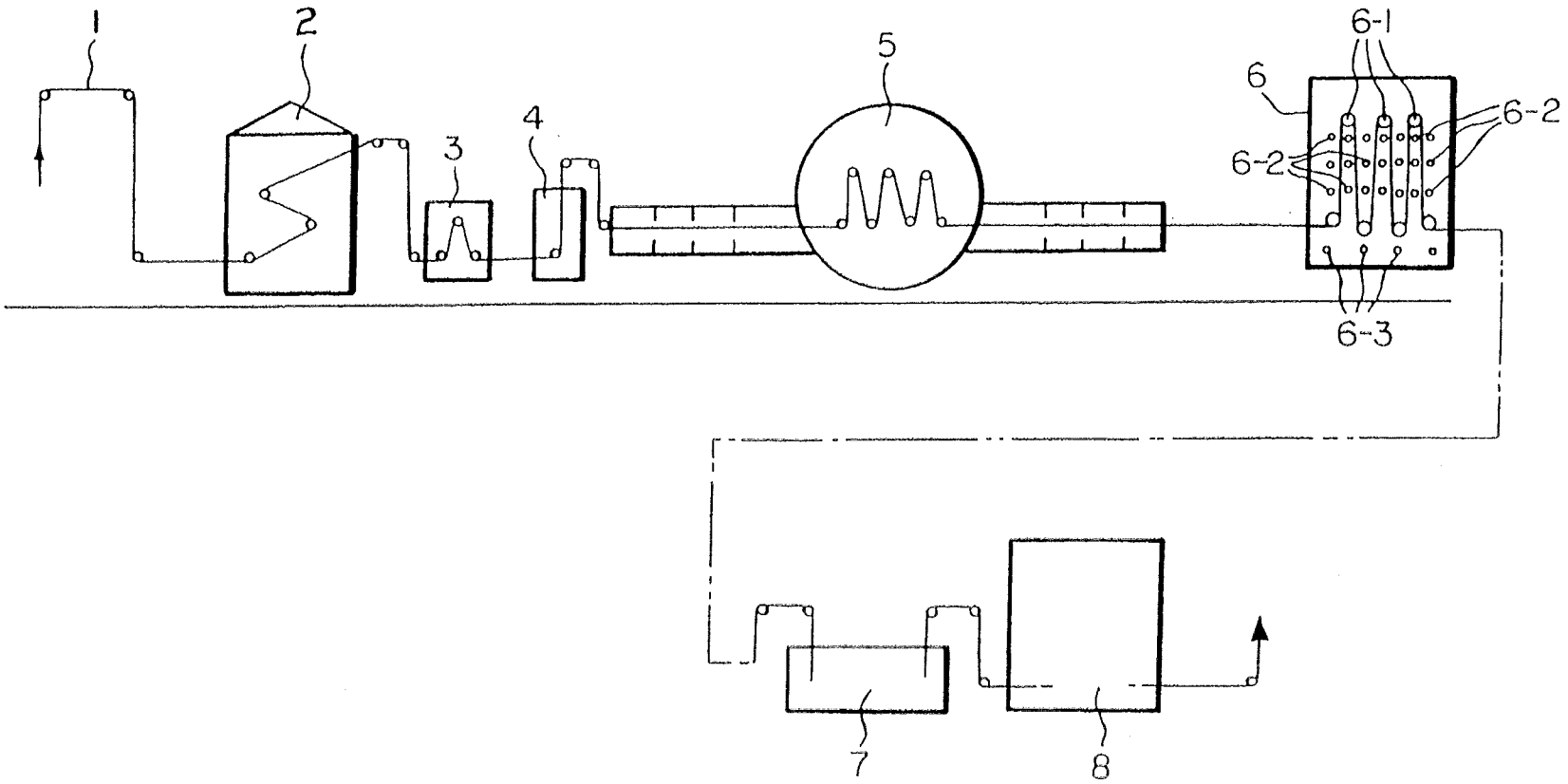
6-2
6-1
6-3
6
6-2
5
4
3
2
1
8
7

METHOD AND APPARATUS FOR THE PRETREATMENT OF A CLOTH

BACKGROUND OF THE INVENTION

1. Field of the Invention:

The present invention relates to a method and an apparatus for the pretreatment of a cloth in a gaseous system with no need of using a treating solutions.

2. Description of the Related Art

The conventional continuous pretreatment of a long cloth produced commercially, namely a series of such treatments as desizing, scouring and bleaching, is done as follows. After the singeing treatment, the cloth is washed with water, and the thus singed cloth is soaked with a treating solution for desizing and scouring, and the resultant cloth is subjected to the wet heat treatment for desizing and scouring by using, for instance, a L-box, a J-box or a Parble Range disclosed by the present inventors, and then, if necessary, the bleaching treatment is done by the wet heat treatment with the use of a bleaching solution.

However, in such a conventional method for the continuous pretreatment of a long cloth produced commercially, since a treating solution and a wet heat are necessitated, the improvement thereof is required from the standpoint of economy. Moreover, the public pollution due to the drugs in the waste liquor after the treatment and the like is serious problem, and therefore, such an apparatus for the treatment of the waste liquior is not suitable because the production cost is increased.

SUMMARY OF THE INVENTION

Under such circumstances, the present inventors have developed a method and an apparatus for the scouring of a cloth only in a gaseous system with no application of an aqueous system. For instance, desizing and scouring of a cloth can satisfactorily be done with the use of low temperature plasma in a gaseous system. However, in such a low temperature plasma process, and effective bleaching process can not be done, and therefore, an aqueous bleaching process, for instance with the use of an aqueous solution of sodium chlorite or hydrogen peroxide, must be applied. Thus, there still remains the problem of treating the waste solution and exhaust gas with no danger of public pollution as above mentioned.

Accordingly, in paying attention to such problems, the present invention is to offer a method and an apparatus for the continuous pretreatment of a long cloth produced commercially including desizing, scouring and bleaching completely in gaseous system. Practically, by utilizing the combination of a desizing and scouring process, in which a low temperature plasma atmosphere is maintained, and a bleaching process, in which an atmosphere comprising ozone and ultraviolet ray radiation is maintained, the object of the present invention can be attained completely in a gaseous system with entirely no application of liquid system.

BRIEF DESCRIPTION OF THE DRAWINGS

FIG. 1 is an explanatory drawing showing the present inventive apparatus for the pretreatment of a cloth continuously.

DETAILED DESCRIPTION OF THE PREFERRED EMBODIMENTS

The present invention will be describes more in details referring to FIG. 1 showing the apparatus for the present invention.

In the FIG., 1 is a long cloth to be pretreated, and in the first place the fluffs on the surface of said cloth are burnt off with the use of gas by passing the cloth through the singeing machine 2. (Since such a singeing machine 2 is well known, the explanation of the construction thereof will be omitted in this place.) The cloth thus singed with the said singeing machine is passed through a dust collector 3 with the use of air or corona discharge so as to remove such matters as the burnt dust adhering to the cloth, and then sent into the interior of the drier 4 in the next place. In the interior of said drier, the water contained in the cloth 1 is removed completely, and the cloth becomes in the dried state. The thus dried cloth is then supplied into the interior of the low temperature plasma treating apparatus 5. (As for the low temperature plasma treating apparatus 5, any one can optionally be selected among the ones disclosed by the present inventors.)

After all, while the cloth 1 is passing through the interior of the low temperature plasma treating apparatus 5, the singeing agent and other impurities adhesing on the cloth are decomposed due to the effect of the low temperature plasma, and thus the desizing and scouring treatment of the cloth are completed.

The cloth 1 passed through the low temperature plasma treatment apparatus 5 is supplied into the bleaching apparatus 6. The construction of the interior of said bleaching apparatus is comprising a group of guide rolls 6-1 for elongating the stay time of the cloth 1 in the bleaching apparatus 6 by transporting the cloth zigzag therethrough, a plurality of ultraviolet ray lamps 6-2 for radiating the ultraviolet ray with a length of, for instance, 160–380 nm to both sides of the cloth 1 transported by means of said group of guide rolls 6-1, and an ozone breathing out nozzles 6-3 so as to maintain the concentration of ozone in said bleaching apparatus for example to more than 500 ppm.

Thus, the cloth 1 is bleached while it is passing through the bleaching apparatus 6. By the way, 7 is a washing machine with the use of water, and 8 is a drier.

As shown in this example, the continuous desizing and scouring treatment of a cloth is done in an gaseous system comprising low temperature plasma atmosphere, and in succession thereto, the bleaching treatment of said cloth is done in an gaseous atmosphere containing ultraviolet ray and ozone. Thus, the continuous pretreatment of a long cloth including desizing, scouring and bleaching can completely be done en bloc in gaseous system. Thus, as compared with the conventional methods with the use of aqueous system, the present inventive method can be done by eliminating the use of chemicals, water resource and heat energy, and consequently its economical merit is quite remarkable. Moreover, since the use of chemicals and water resource are spared, the public pollution due to waste water and exhaust gas can completely be avoided. Thus, the present continuous pretreatment of a long cloth is the one free from the danger of public pollution.

In the present invention, particularly, since the bleaching process is done in a gaseous atmosphere containing ultraviolet ray and ozone in combination, the time for bleaching can be reduced to about 1/10 as compared with the case of using ultraviolet ray only. Accordingly, the efficiency of pretreatment in total can distinctly be improved, and its productivity can largely be elevated in the present invention.

As described in the above, the present invention relates to a method and an apparatus for the continuous pretreatment of a long cloth, in which, after the desizing and scouring of the cloth in a low temperature plasma atmosphere, the resultant cloth is subjected to bleaching by radiating ultraviolet ray thereto in an ozone atmosphere. Therefore, the present invention can be done in a gaseous system with no need of using liquid and chemicals, and thus causing no public pollution due to the use of liquid and chemicals. In this way, the present invention is the one free from the danger of public pollution. Further, since the present invention relates to a treatment entirely in gaseous system, the use of chemicals, water resource and heat energy can be omitted, and thus its commercial merit can largely be improved as compared with the conventional pretreatment of a cloth in liquid system.

Moreover, in the present invention, since the time for bleaching can as already stated largely be shortened, and therefore, its productivity can effectively be elevated largely.

What is claimed is:

1. A method for the continuous pretreatment of a cloth comprising desizing and scouring the cloth in a low temperature plasma atmosphere and bleaching the thus treated cloth by irradiation with ultraviolet rays in an ozone atmosphere, said desizing, scouring and bleaching being carried out in the absence of a liquid system.

* * * * *